US005135226A

United States Patent [19]

Place

[11] Patent Number: 5,135,226

[45] Date of Patent: Aug. 4, 1992

[54] SINGLE-FINGER GRIPPING DEVICE

[76] Inventor: Dennis Place, 8 Tower Rd., Lexington, Mass. 02173

[21] Appl. No.: 682,557

[22] Filed: Apr. 9, 1991

[51] Int. Cl.[5] ..... A63B 71/14; A41D 13/08

[52] U.S. Cl. ..... 273/166; 273/81 D; 2/21

[58] Field of Search ..... 273/81 D, 165, 166, 273/162 F, 54 B, 73 R, 75, 26 C; 2/2, 21, 161 A, 163, 167, 168; 223/101

[56] References Cited

U.S. PATENT DOCUMENTS

| | | | |
|---|---|---|---|
| D. 228,977 | 11/1973 | Kanicki | D2/361 |
| 310,108 | 12/1884 | Winzenried | 2/21 X |
| 518,027 | 4/1894 | English . | |
| 534,211 | 2/1895 | English | 2/21 |
| 587,123 | 7/1897 | Holcomb | 223/101 |
| 942,003 | 11/1909 | Marsh | 2/21 X |
| 1,285,473 | 11/1918 | Tripp | 273/54 B |
| 1,863,960 | 6/1932 | Aronson . | |
| 2,079,261 | 5/1937 | Pardoe | 273/166 |
| 2,309,476 | 1/1943 | Patterson | 2/159 |
| 2,379,624 | 7/1945 | Chisnell | 2/21 X |
| 3,038,723 | 11/1961 | Bergendorf | 273/54 |
| 3,248,112 | 4/1966 | Metzger | 273/54 B |
| 3,343,177 | 9/1967 | Bellamy | 273/166 X |
| 3,875,591 | 4/1975 | Cantales | 2/161 |
| 3,880,426 | 4/1975 | Morse | 273/54 |
| 3,930,271 | 1/1976 | Kahng | 2/161 |
| 4,025,077 | 5/1977 | Thompson | 273/166 |
| 4,062,540 | 12/1977 | Calentine | 2/21 X |
| 4,590,625 | 5/1986 | Keim | 2/161 |
| 4,796,302 | 1/1989 | Davis et al. | 2/21 |
| 4,892,315 | 1/1990 | Iorlano | 273/166 |

FOREIGN PATENT DOCUMENTS

| | | | |
|---|---|---|---|
| 0220452 | 5/1987 | European Pat. Off. | 2/163 |

*Primary Examiner*—Paul E. Shapiro
*Assistant Examiner*—Sebastiano Passaniti
*Attorney, Agent, or Firm*—Hamilton, Brook, Smith & Reynolds

[57] ABSTRACT

A single-finger gripping device is particularly useful for providing a non-slip grip surface at the pivot point between the handle of a golf club and the hand of a golfer using a conventional overhand grip. Preferably made of a thermoplastic material, the device is annularly shaped and fits around the index finger of a wearer without putting constricting pressure thereupon. The outer surface of the device is smooth and the inner surface has cleats which extend inwardly from the inner surface. The cleats provide friction between the device and a finger beneath when pressure on the club handle from the wearer's thumb presses the device against the finger. Perforations in the device provide good aeration to the finger as does the elevation of the ring away from the finger by the cleats. The perforations pass through the cleats such that compression of a cleat between the finger and the club handle creates a suction cup effect within the body of the cleat spacing between the club handle and the wearer's hand provided by the device reduces friction between the club handle and the hand.

11 Claims, 2 Drawing Sheets

SINGLE-FINGER GRIPPING DEVICE

BACKGROUND OF THE INVENTION

In the game of golf, a player swinging a golf club typically experiences motion of the club handle relative to the player's hand. Typically, a right-handed golfer, using a standard overhand grip, grips the club handle with the left hand such that the left thumb presses the handle against the left index finger. The right hand then grips the handle below the left hand. As the club is swung, the club handle pivots about the contact points formed between the club handle and the left index finger. A left-handed golfer grips the club in a similar fashion, only with the hands reversed. Thus, a pivot point is formed between the club handle and the right index finger for the left-handed golfer.

Friction between the club handle and the pivot point on a golfer's index finger must be maintained in order to prevent slipping of the club in the golfer's hands. Perspiration or other moisture on the hands can prevent good high-friction contact at this pivot point. Therefore, the club may twist or slip in the golfer's hands, resulting in a less accurate shot.

In addition to the need for high friction contact, many players experience irritation at the index finger pivot point due to repeated swinging of the club. The common solution to the problems of slippage and irritation is the wearing of a glove on the golfer's hand (the left hand for a right handed golfer or the right hand for a left handed golfer). Most golf gloves are leather, or a similar material which allows the hand to breathe. However, these gloves can be uncomfortable to wear, and absorb perspiration moisture, eventually becoming wet on a warm day. A wet glove can be very uncomfortable to wear, and the wet glove is usually less effective than a dry glove in allowing a fluid swing about a single contact point.

SUMMARY OF THE INVENTION

A single-finger sports grip includes an annular ring of resilient material having raised surface portions along its inner surface. The ring is sized such that with the material of the ring in a relaxed state, the ring fits about a finger of a wearer with no constricting pressure thereupon. The grip is most preferably worn by a golfer on the index finger of the hand in which the club handle pivots (the left hand for a right handed golfer or the right hand for a left handed golfer). It may also be preferred to wear one grip on the index finger of each hand. Since the grip fits loosely about the wearer's finger without putting constricting pressure on the finger, it does not cut off the flow of blood to the finger or otherwise make the wearing of the grip uncomfortable.

The raised surface portions on the inside of the ring are preferably cleats which extend inwardly from the inner surface of the ring. In addition, perforations are distributed about the circumference of the ring to provide ventilation to the portion of the finger under the ring. In the preferred embodiment, perforations pass directly through the cleats such that a suction cup effect is created at each cleat when compressed between the club handle and the wearer's finger. Further in the preferred embodiment, the cleats are cylindrically shaped. When the handle of a golf club presses the ring against the finger due to thumb pressure on the opposite side of the handle, high friction contact is formed between cleats of the ring and the wearer's finger, and between the club handle and the ring.

The material of the ring is sufficiently resilient so that it may be deformed and still resume its original annular shape and diameter. A preferred material is a thermoplastic such as a variation of polypropylene. The material is non-absorbent, and should reassume its original size and ring shape after being deformed. The perforations and spacing from the finger provided by the cleats allows the finger underneath to remain cool and dry. In addition to the thickness of the ring, the cleats provide a surface elevated from the surface of the finger to space the club handle from the finger and reduce contact between the club handle and the finger and other parts of the hand.

DETAILED DESCRIPTION OF A PREFERRED EMBODIMENT

Figure 1:
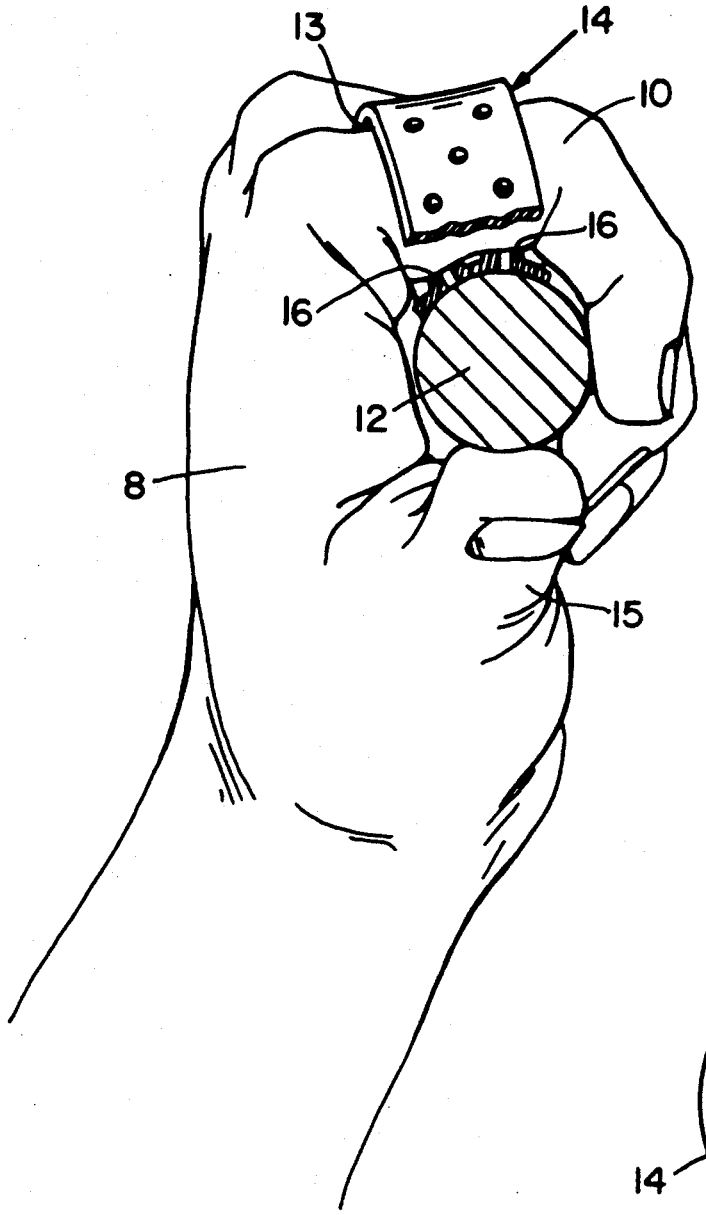
FIG. 1 is a perspective view of the grip device of the present invention as worn on a golfer's hand when gripping a golf club with a portion of the grip device broken away to show details.

Shown in FIG. 1 is a perspective view of a golfer's hand 8 gripping a golf club 12 using the gripping device 14 of the present invention. The figure assumes a regular overhand grip by a right-handed golfer, and only the left hand is shown, the view being up the length of the club shaft in the direction of the handle. It should be noted that in the case of a left-handed golfer, the right hand would be shown in the figure, the grip being the same, only in the opposite hand.

The gripping device 14 is an annular ring of thermoplastic material such as a styrenic block copolymer (SBC), although other resilient materials may work just as well. As shown in the figure, the device 14 fits loosely around the index finger 10, and has raised surface portions 16 extending inwardly from its inner surface. With the thumb 15 of the golfer pressing the club handle 18 against the ring 14, the raised surface portions are pressed into firm, high-friction contact with the finger 10. The thermoplastic material provides good, non-slip surface contact between the club handle and the ring 14. The finger on which the device 14 is worn in FIG. 1 is the index finger 10. When using a standard overhand grip, the swinging of a golf club usually involves a pivot point at the location where the ring 14 is worn in FIG. 1. The material of device 14 provides good gripping contact between the club handle and the golfer's hand at that point, and also protects that part of the finger 10 from irritation which might otherwise result from the motion of the club handle at the pivot point.

The loose fit of the gripping device 14 is demonstrated in FIG. 1 by the space 13 between the ring 14 and the side of the finger opposite the club handle 18. It is not necessary that the fit be as loose as is indicated in FIG. 1, as long as the ring slides onto the finger when the material of the device is in a relaxed state, and as long as the device places no constricting pressure on the finger. For commercial purposes the device 14 is made in a variety of different sizes, since finger size varies from one golfer to another. Thus, each golfer can select the gripping device 14 which best fits their own finger. As an alternative, the ring may be made adjustable by manufacturing it as a strip. Spaced along a portion of the strip are located snaps or other types of connectors to allow connecting the strip to itself as a ring of any of a number of different desired diameters.

Figure 2:
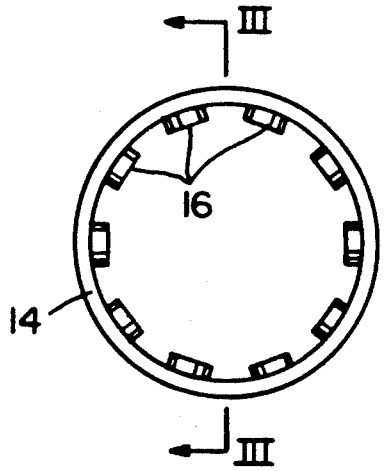
FIG. 2 is an end view of the grip device of FIG. 1.

An end view of the ring gripping device 14 is shown in FIG. 2. In the preferred embodiment, the raised surface portions 16 are cleats which are arranged in rows. As shown in FIG. 2, the cleats extend inwardly from the inner surface of the ring 14. The thickness of the ring (from the inner surface to the outer surface) in the preferred embodiment is between 0.1 cm. and 0.2 cm., with the cleats extending from between 0.05 cm. and 0.1 cm. inward from the inner surface. However, these dimensions may be varied without substantially changing the functionality of the invention.

Figure 3:
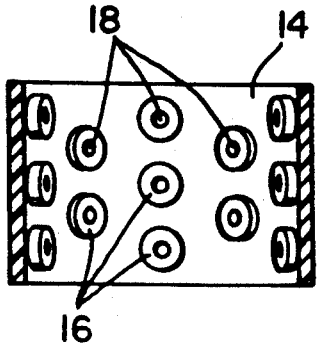
FIG. 3 is an view of the inner surface of a grip device of the present invention.

The arrangements of cleats 16 in the preferred embodiment is demonstrated in FIG. 3 which is a cross section of FIG. 2 showing the inner surface of the ring. The cleats 16 are cylindrically shaped, extending from the inner surface of the ring 14 (as shown in FIG. 2) and each terminates at a flat contact surface. The inner surface of the ring, as shown in FIG. 3, is essentially a matrix supporting the array of cleats 16. The cleats of this matrix are arranged in rows, the location of the cleats in each row being staggered relative to the location of the cleats in each contiguous row. In particular, the arrangement shown in FIG. 3 has the cleats of each row lined up with a center line passing between adjacent cleats of a contiguous row. Thus, the cleats 16 of every other row are aligned along the same circumferential line.

Perforations 18 passing through the ring 14 pass directly through the cylindrical cleats. Each perforation 18 thus allows a suction to be created within the body of a cleat compressed between the club handle 12 and the wearer's finger 10. Specifically, opposing pressure from the wearer's thumb causes compression and deformation of cleats 16 which are positioned between the finger 10 and the handle 12. The deformation of a cleat 16 causes air within the body of the cleat to be forced out. The resilience of the material then creates a suction cup type effect if pressure on the cleat is reduced. This effect at each of the cleats 16 being compressed helps keep the ring 14 from moving relative to the finger 10 during a swing. Thus, in addition to the high-friction contact between the ring 14 and the club, and between the ring 14 and the finger 10, the suction effect serves to even further secure the club relative to the golfer's hands.

Good slippage prevention is also provided by the staggered arrangement of the cleats 16 along the inner surface of the ring 14 by providing contact between the ring 14 and the finger at varied axial positions along the surface of the ring. While the club is gripped, two or three rows of cleats 16 are in contact with the finger 10 at a time. With each row of cleats being staggered one position relative to contiguous rows, the friction opposing twisting of the ring 14 about the finger is more spread out than if the cleats were aligned with one another in columns as well as in rows.

As mentioned previously, the ring 14 is sized so that it fits the wearer's finger with no constricting pressure on the finger 10. One advantage of the loose fit of the ring 14 is good aeration of the finger to keep the finger cool and dry. This aeration is further enhanced by both the perforations 18 and the cleats 16 of the ring 14. Since the preferred material of the ring is a non-absorbant thermoplastic, air does not pass through the material to let the finger breathe. However, the small size of the device 14 and the loose fit allow air to get to the finger beneath. Air passes through the perforations 18 of the ring which are not covered by the club handle 12 or finger 10 to even better aerate the skin. The cleats 16 which do contact the finger 10 keep the majority of the inner surface of the ring 14 spaced away from the surface of the finger 10, and therefore allow air flow between the ring 14 and the finger 10. The position of the ring 14 on the finger is also easily adjusted by the wearer by twisting the loose ring when there is no pressure applied pressing the ring 14 against the finger 10. This repositions the device 14 on the finger 10 and exposes portions of the finger which may have been previously covered by a cleat.

Another feature of the present invention is partially illustrated by FIG. 1. The contact between the club handle 12 and the device 14 provides spacing between the handle 12 and the finger 10. During a swing, this spacing also keeps the club handle 12 from the rest of the golfer's hand. While friction at a single point of contact is desirable to keep the club from slipping in the golfer's hands, friction generated between the hands and the club handle away from the pivot point is undesireable, as it tends to restrict the movement of the club. The spacing of the club handle away from the hands reduces contact between the hands and the club handle away from the pivot point, and thus reduces restriction of the club pivoting due to friction. This results in a smoother, and easier pivoting of the club in the hands, and consequently allows for a smoother, easier swing.

The spacing created by the ring provides a distinct advantage over a conventional golf glove which covers the whole hand, and does not provide any such separation. With a glove the club can drag against the high friction material covering the rest of the hand, thus restricting the pivoting of the club. This effect may be particularly noticeable if the glove has become wet with perspiration or other moisture. In addition to producing a better swing, the spacing of the club handle away from the hands also reduces irritation at parts of the hand away from the pivot point, since the club handle does not tend to rub repeatedly against the golfer's hand.

Figure 4:
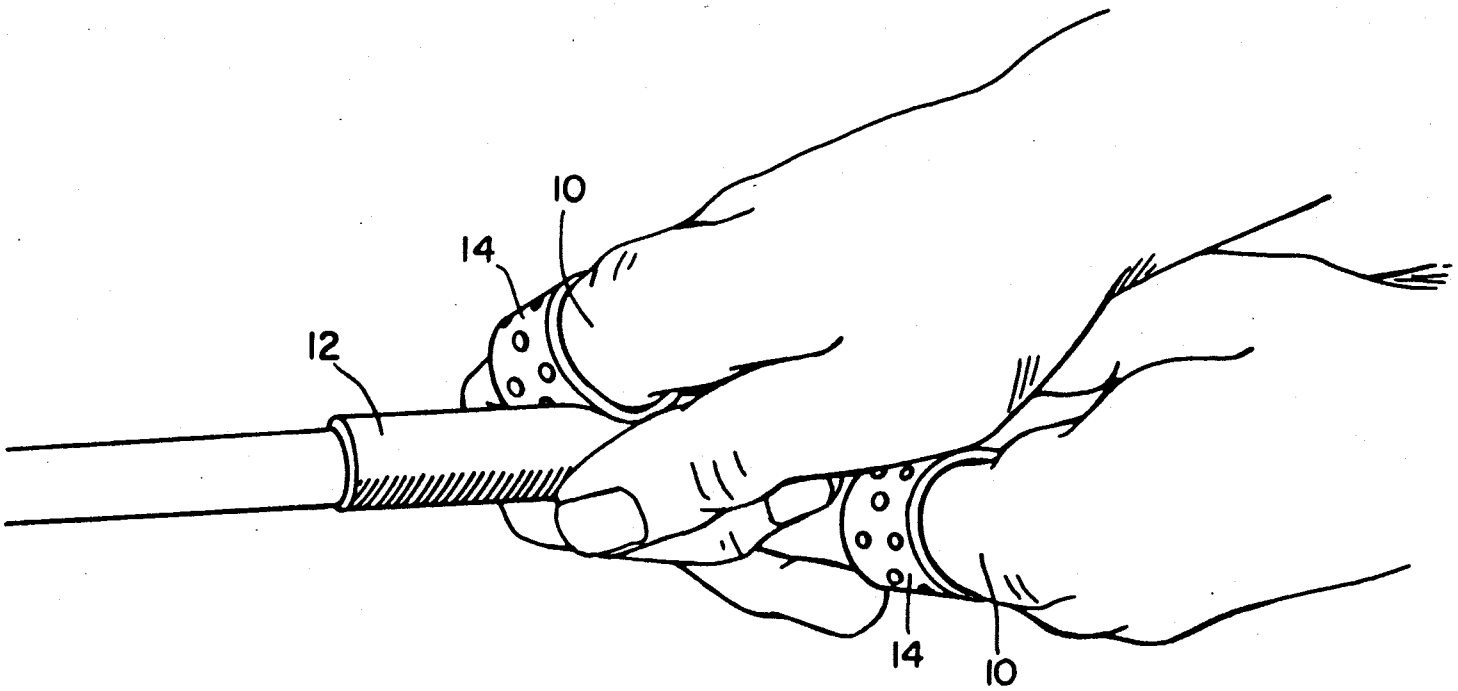
FIG. 4 is a perspective view of a golfer's hands holding a golf club with a grip device on the index finger of each hand.

FIG. 4 is a perspective view of a right-handed golfer's hands holding a club handle 12 in a typical overhand grip. If this was a left-handed golfer, the position of the hands would be reversed. In FIG. 4, a ring grip device 14 is worn on the index finger 10 of each hand. Although the upper hand of the grip is typically the hand in which the club points, it may be desireable to provide extra gripping ability to the lower hand by wearing a ring 14 on the index finger of that hand as well. The index finger is chosen for illustrative purposes in FIG. 4, but the device may be worn on any finger of either hand, to suit the particular golfer wearing the device 14.

While the invention has been particularly shown and described with reference to a preferred embodiment thereof, it will be understood by those skilled in the art that various changes in form and detail may be made therein without departing from the spirit and scope of the invention as defined by the appended claims.

The selection of the index finger of the upper hand of a golf grip for illustrating the use of the device is based on the fact that this is the typical location of a pivot point in the average golfer's swing. The device may also be worn on any finger of either hand if the wearer so desires. Furthermore, use of the device is not limited to the sport of golf. Racquet sports such as tennis and racquetball are examples of other sports in which the present invention may be beneficial. Even outside the realm of sports, the device may be useful, such as for protecting the hands of a worker holding hand tools. In general, any application in which a comfortable, high friction, well-aerated grip device is useful would benefit from the present invention.

I claim:

1. A single-finger golf club grip device for gripping the handle of a golf club comprising:

an annular ring of resilient material having an outer surface and an inwardly extending inner surface, said inner surface having a plurality of raised surface portions each positioned along a longitudinal axis perpendicular to a plane containing the inner surface, the ring being sized such that with the material of the ring in a relaxed state, the ring fits about the base of an index finger of a wearer; and perforations extending through the axis of said surface portions for enabling air to be channeled between the outer surface and the inner surface for creating a vacuum between the index finger and said golf club handle when the wearer grips the golf club handle to increase friction between the ring and handle.

2. A golf grip device according to claim 1 wherein the raised surface portions are hollow cylindrically shaped cleats.

3. A golf grip device according to claim 2 wherein the perforations are aligned with each respective cleat and distributed about the circumference of the ring.

4. A golf grip device according to claim 1 wherein the entire outer surface of the ring apart from any portions of the ring having said perforations has a smooth texture.

5. A golf grip device according to claim 1 wherein the material of the ring comprises a thermoplastic.

6. A golf grip device according to claim 1 wherein with the material of the ring in a relaxed state, the ring fits about the base of the index finger of the wearer with substantially no constricting pressure thereupon.

7. A single-finger golf club handle gripping device comprising:

a length of resilient thermoplastic material having an inner and an outer surface formed in an annular ring, said material having perforations spaced about the length, and extending from the outer to the inner surface with a plurality of raised cleats extending away from the inner surface, the ring being sized such that with the thermoplastic being in a relaxed state, the ring fits about the base of an index finger of a wearer with no constricting pressure thereupon; and said perforations enabling air to be channeled between the outer surface and the inner surface for forming a vacuum between the index finger and the golf club handle when the wearer grips the golf club handle.

8. A golf grip device according to claim 7 wherein the thermoplastic comprises a styrenic block copolymer.

9. A single-finger golf club handle gripping device comprising:

an annular ring of resilient thermoplastic having a plurality of raised cleats spaced about an inner circumference of the ring and extending away from an inner surface of the ring, the ring being sized such that with the thermoplastic being in a relaxed state, the ring fits about the base of an index finger of a wearer with no constricting pressure thereupon, and perforations extending through a center of a respective cleat for enabling air to be channeled through said perforations for causing a vacuum to form between the index finger and a surface of the gripped golf club handle.

10. A method of gripping a golf club handle comprising:

providing an annular ring of resilient material having a plurality of raised centrally perforated hollow and cylindrically shaped cleats extending away from an inner surface of said ring, the ring being sized such that with the resilient material in a relaxed state, the ring fits about the base of an index finger of a wearer with no constricting pressure thereupon;

placing the ring about the base of the index finger; and gripping the handle of a golf club such that pressure from the thumb forces the handle to press against the ring such that some of the cleats of the ring are pressed into the thick fleshy portion of the index finger of the wearer forcing air out of a chamber formed by the perforated cleats and creating a vacuum between said index finger and the handle.

11. A method according to claim 10 wherein creating a vacuum further comprises providing pressure from the thumb of the wearer which compresses at least one of said cleats and creates a suction effect within a chamber formed by said perforations extending through a said at least one cleat as compression of the cleat is reduced.

* * * * *